US010662580B1

(12) United States Patent
Tutterow

(10) Patent No.: US 10,662,580 B1
(45) Date of Patent: May 26, 2020

(54) METHOD FOR DYEING MODACRYLIC/CELLULOSIC BLEND FABRICS

(71) Applicant: Mount Vernon Mills, Inc., Mauldin, SC (US)

(72) Inventor: D. Craig Tutterow, Rome, GA (US)

(73) Assignee: MOUNT VERNON MILLS, INC., Mauldin, SC (US)

( * ) Notice: Subject to any disclaimer, the term of this patent is extended or adjusted under 35 U.S.C. 154(b) by 0 days.

(21) Appl. No.: 16/515,900

(22) Filed: Jul. 18, 2019

(51) Int. Cl.
*D06P 1/22* (2006.01)
*D06P 3/70* (2006.01)

(52) U.S. Cl.
CPC ..... *D06P 1/221* (2013.01); *D06P 3/701* (2013.01)

(58) Field of Classification Search
CPC ..... D06P 1/221; D06P 1/22; D06P 3/6025; D06P 3/523; D06P 1/222; D06P 3/403; D06P 3/463; D06P 3/701; D06P 3/793; D06P 3/60; D06P 1/65106; D06P 3/042; D06P 3/141
See application file for complete search history.

(56) References Cited

U.S. PATENT DOCUMENTS 4,950,306 A * 8/1990 Marte ..... D06P 1/22 8/607
2003/0110580 A1* 6/2003 Burkinshaw ..... C09B 67/0077 8/506
2004/0172774 A1* 9/2004 Birkinshaw ..... D06P 1/221 8/519
2005/0097685 A1* 5/2005 Seuthe ..... D06P 1/221 8/518

* cited by examiner

*Primary Examiner* — Eisa B Elhilo
(74) *Attorney, Agent, or Firm* — Fox Rothschild LLP

(57) ABSTRACT

A method for dyeing a modacrylic/cellulosic fabric includes the steps of providing a fabric comprising modacrylic fibers and cellulosic fibers. An aqueous vat dye composition comprising water and a vat dye is applied to the fabric to provide a vat dyed modacrylic/cellulosic fabric. The vat dyed modacrylic/cellulosic fabric is dried. The vat dyed modacrylic/cellulosic fabric is then contacted with a reducing agent. The vat dyed modacrylic/cellulosic fabric is then steamed to promote dye penetration into the fibers. The vat dyed modacrylic/cellulosic fabric is then washed in a first wash step with a wash composition comprising water to remove excess vat dye and reducing agent. The vat dyed modacrylic/cellulosic fabric is contacted with an oxidation oxidizing agent. The vat dyed modacrylic/cellulosic fabric is washed in a second wash step to remove excess oxidation agent.

19 Claims, 1 Drawing Sheet

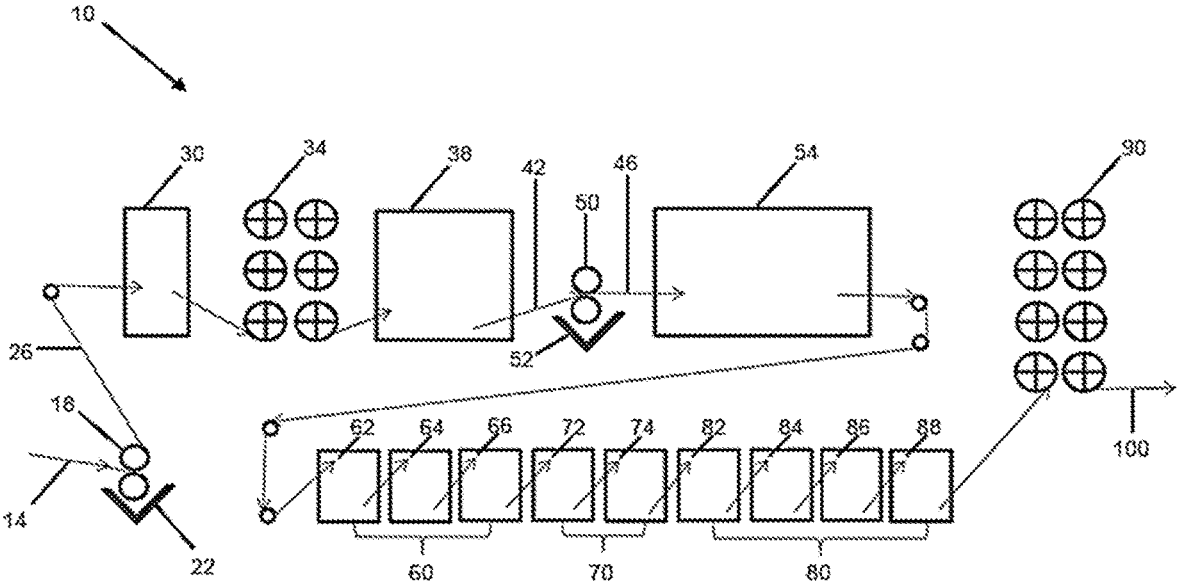
10
30
34
38
42
46
50
54
90
26
52
18
14
22
62
64
66
72
74
82
84
86
88
100
60
70
80

METHOD FOR DYEING MODACRYLIC/CELLULOSIC BLEND FABRICS

FIELD OF THE INVENTION

The present invention is related to methods of dyeing modacrylic/cellulosic blend fabrics.

BACKGROUND OF THE INVENTION

Modacrylic fibers are composed of modified acrylic fibers made from acrylonitrile groups, often as copolymers made with some amount of other polymer. The Federal Trade Commission defines modacrylic fibers as manufactured fibers in which the fiber-forming substance is any long chain synthetic polymer composed of less than 85%, but at least 35 weight percent acrylonitrile units. 16 CFR § 303.7 (b). Modacrylics have many desirable properties, including strength and resilience, resistance to chemicals and solvents, resistance to insects and mildew, quick drying, non-allergenic, good shape retention, flame resistance, and are soft to the touch. Modacrylic fibers are often combined with cellulosic fibers to produce flame resistant modacrylic/cellulosic blend fabrics.

Vat dyes are a group of dyes which are not water soluble in their normal form. Vat dyes are made to be water soluble by the chemical process of reduction, usually with a reducing agent such as sodium hydrosulfite and an alkali such as sodium hydroxide. The reduced form of the dye is known as the lueco form. Vat dyes have high wash fastness, are usually very lightfast, and are resistant to chlorine bleach. Vat dyes are typically used for garments and other items which will be subjected to multiple washings. Vat dyes require several complex chemical steps, and control of appropriate conditions. Due to various reasons, including the complex dyeing process, vat dyes are used more with continuous dyeing than in exhaust processing. Vat dyes are particularly well suited for dyeing cotton fibers. In the lueco form, the vat dye is highly water-soluble and is highly attracted to the cotton fiber where it rapidly absorbs into the fiber structure. The vat dyes are then oxidized to return them to the insoluble form, resulting in the vat dye being secured within the cotton fiber. Vat dyes are highly resistant to chlorine and exhibit good color fastness properties on cotton fiber.

Vat dyes are typically not used for dyeing modacrylics. A class of dyes known as basics or cationics is used because these dyes provide a cationic, positively charged dye molecule to link with an anionic negatively charged dye site on the modacrylic fiber. A typical dye bath for modacrylics is acidic comprising an acid such as acetic acid (pH 3.5-5.0). Also, modacrylics are not very absorbent. Accordingly, vat dyes are not useful for dyeing modacrylic/cellulosic blend fabrics because, while the cellulosic fibers will readily take up the dye, the modacrylic fibers generally will not. This results in uneven dyeing and an undesirable result.

There are two broad methods for dyeing textiles; continuous and exhaust or batch dyeing. Continuous dyeing methods employ a dye range with equipment to apply, process and dry fabrics. On a continuous dye range fabric may be dyed without stopping, as a new roll of fabric is sewn to the end of a previous roll so that the range does not have to be stopped. Exhaust dyeing is a batch process wherein fabric to be dyed is loaded into a vessel for dyeing, water, dye and chemicals are added to the vessel by a specific recipe, the bath heated, rinsed and washed before the vessel is unloaded. The wet, dyed fabric is taken to another machine for drying. The basic or cationic dyes conventionally used for dyeing modacrylic fibers do not lend themselves to dyeing by the continuous method, so modacrylic fabrics are traditionally dyed by a batch process. The invention allows for modacrylic-containing fabrics to be dyed by the continuous method, using vat dyes that are well suited to this method of application.

SUMMARY OF THE INVENTION

A method for dyeing a modacrylic/cellulosic blend fabric includes the step of providing a modacrylic/cellulosic blend fabric comprising modacrylic fibers and cellulosic fibers. An aqueous vat dye composition comprising water and a vat dye is applied to the modacrylic fabric to provide a vat dyed modacrylic/cellulosic blend fabric. The vat dyed modacrylic/cellulosic blend fabric is dried. The vat dyed modacrylic/cellulosic blend fabric is contacted with a reducing agent. The vat dyed modacrylic fabric is steamed to promote dye penetration into the fibers. The vat dyed modacrylic fabric is washed in a first wash step with a wash composition comprising water to remove excess vat dye and reducing agent. The vat dyed modacrylic fabric is then contacted with an oxidizing agent. The vat dyed modacrylic fabric is washed in a second wash step to remove excess oxidizing agent.

The oxidizing agent can include hydrogen peroxide. The oxidizing agent can be 50% hydrogen peroxide titrated to a 5% solution. The oxidation step can include the step of contacting the vat dyed modacrylic fabric with an alkaline stable surfactant solution having a pH of from 7.2 to 7.8.

The reducing agent can include at least one selected from the group consisting of sodium hydroxide and sodium hydrosulfite. A wetting agent can also be used.

The drying step can include infrared drying. The drying step can include hot flue drying. The drying step can include the step of passing the vat dyed modacrylic fabric over heated steam cans.

The first wash step can include serial wash steps. Each wash step can have a graduated temperature that is greater than the preceding wash step. The method can include a pressing step after the step of applying an aqueous vat dye composition to the modacrylic fabric. After the application of the oxidation agent, the vat dyed modacrylic fabric can be passed over steam cans.

The vat dye can be at least one selected from the group consisting of Vat Red 10, 13, 15 and 31, Vat Orange 1, 2 and 7, Vat Yellow 2 and 33, Vat Green 1 and 3, Vat Blue 6, 66, Vat Violet 1 and 13, Vat Brown 1, 3, and 57, Vat Grey 2, Vat Black 16, 25, and 27, and combinations thereof. The modacrylic fibers can be at least one selected from the group consisting of Protex-Q, Protex® C, and Protex M. The modacrylic fibers can have a denier per filament (dpf) of from 1.2 to 2. The modacrylic fibers can include from 80-20 wt. % and the cellulosic fibers comprise 20-80 wt. % of the modacrylic/cellulosic blend fabric. The cellulosic fibers can be at least one selected from the group consisting of cotton, rayon, lyocell (Tencel®), flax, ramie, hemp, and jute.

The method can further include the step of treating the dyed modacrylic fabric with a flame retardant compound comprising at least one selected from the group consisting of THPC: tetrakis hydroxymethyl phosphonium chloride, THPS tetrakis hydroxymethyl phosphonium sulfate, and Pyrovatex®.

The method can further include the step of pre-treating yarn used to make the modacrylic/cellulosic fabric with a moisture control agent. The moisture control agent can be at least one selected from the group consisting of StaCool and Sorbtek®.

BRIEF DESCRIPTION OF THE DRAWINGS

There are shown in the drawings embodiments that are presently preferred it being understood that the invention is not limited to the arrangements and instrumentalities shown, wherein:

FIG. 1 is a flow diagram of a process according to the invention.

DETAILED DESCRIPTION OF THE INVENTION

A method for dyeing a modacrylic/cellulosic blend fabric includes the steps of providing a modacrylic/cellulosic blend fabric comprising modacrylic fibers and cellulosic fibers. An aqueous vat dye composition comprising water and a vat dye is applied to the fabric to provide a vat dyed modacrylic/cellulosic blend fabric. The vat dyed modacrylic/cellulosic blend fabric is dried. The vat dyed modacrylic/cellulosic blend fabric is then contacted with a reducing agent. The vat dyed modacrylic/cellulosic blend fabric is then steamed to promote dye penetration into the fibers. The vat dyed modacrylic/cellulosic blend fabric is then washed in a first wash step with a wash composition comprising water to remove excess vat dye and reducing agent. The vat dyed modacrylic/cellulosic blend fabric is contacted with an oxidizing agent. The vat dyed modacrylic/cellulosic blend fabric is washed in a second wash step to remove excess oxidizing agent.

The modacrylic fibers can be selected from many available modacrylic fibers. For example, Kaneka Corporation (Tokyo, Japan) produces the following modacrylic fibers—Protex-Q; Protex® C and Protex® M. The C and M are modacrylics commonly used in flame resistant fabrics. Other modacrylic fibers and fiber manufacturers that are possible include, for example, Modac 28 and Modac 32 by Aramid HPM LLC (Hilton Head, S.C.), Tairylan by Formosa Plastics Corporation, U.S.A. (Livingstone N.J.), and PyroTex by PyroTex Industries GmbH (Hamburg Germany). Other modacrylic fibers and fiber manufacturers are possible.

The size of the modacrylic fiber filaments can vary. Fibers are usually described in dpf, or denier per filament. This is defined as the weight in grams of 9000 meters of filament. In one embodiment, the deniers per filament (dpf) of the modacrylic filaments is from 1.2 to 2.

The cellulosic fiber that is used in the modacrylic/cellulosic blend fabric can vary. The cellulosic fibers can comprise at least one selected from the group consisting of cotton, rayon, lyocell (Tencel®), flax, ramie, hemp, jute. Combinations of cellulosic fibers are possible, and other cellulosic fibers are possible.

The term modacrylic/cellulosic blend fabric as used herein means a fabric with at least 20% modacrylic fibers, and at least 20% by weight cellulosic fibers, by total weight of the fabric. The proportions of cellulosic fibers to modacrylic fibers in the modacrylic/cellulosic blend fabric can vary. The ratio of modacrylic fibers to cellulosic fibers, by weight, can be from 80/20 to 20/80. The ratio of modacrylic fibers to cellulosic fibers, by weight, can be 80/20, 79/21, 78/22, 77/23, 76/24, 75/25, 74/26, 73/27, 72/28, 71/29, 70/30, 69/31, 68/32, 67/33, 66/34, 65/35, 64/36, 63/37, 62/38, 61/39, 60/40, 59/41, 58/42, 57/43, 56/44, 55/45, 54/46, 53/47, 52/48, 51/49, 50/50, 49/51, 48/52, 47/53, 46/54, 45/55, 44/56, 43/57, 42/58, 41/59, 40/60, 39/61, 38/62, 37/63, 36/64, 35/65, 34/66, 33/67, 32/68, 31/69, 30/70, 29/71, 28/72, 27/73, 26/74, 25/75, 24/76, 23/77, 22/78, 21/79, or 20/80. The ratio can be within a range of any high value and low value selected from these values.

Modacrylic fiber is not very absorbent, but the cellulosic fiber readily absorbs the dye when it is padded on. In the case of cotton as a cellulosic fiber, 20% cotton was found to be sufficient to absorb enough dye for a light shade. Too much modacrylic fiber will not provide for the transfer of dye from the cellulosic to the modacrylic fibers. It is believed, without wishing to be bound by theory, that at least some of the dye is initially attaching to the cellulosic fibers, and then is transferred to the modacrylic fibers. As dyes vary in chemistry and composition, the preferable parameters of the process will sometimes have to be determined empirically for particular fibers, fabrics, dye chemistry and composition, and other operating parameters of the particular process.

The modacrylic/cellulosic blend fabric can include other fibers in addition to modacrylic fibers and cellulosic fibers. Such other fibers include nylon and polyester, although others are also possible. The amount of such other fibers should not comprise more than 25%, by total weight of the modacrylic/cellulosic blend fabric.

An aqueous vat dye composition comprising water and a vat dye is applied to the fabric to provide a vat dyed modacrylic/cellulosic blend fabric. Any method of application can be used, including padding, spaying, immersing, wiping and the like. Other methods of application are possible. The relative proportions of vat dye to water can vary. The manufacturer of the vat dye will usually provide acceptable proportions for the particular product. The vat dye pickup is the weight of the absorbed dye solution as a percentage of the weight of the fabric, so for example if 10 grams of fabric picks up 7 grams of dye solution it would 70% wet pickup.

Many different vat dyes are available and can be used with the invention. Vat dyes are catalogued by C.I. (Color Index) number. Royce Global (East Rutherford, N.J.) is a manufacturer of liquid and powder vat dyes. These include:

- Vat Red 10, 13, 15 and 31
- Vat Orange 1, 2 and 7
- Vat Yellow 2 and 33
- Vat Green 1 and 3
- Vat Blue 6, 66, and 2 mixes (more than one dye combined)
- Vat Violet 1 and 13
- Vat Brown 1, 3, 57 and one mix
- Vat Grey 2 mixes
- Vat Black 16, 25, 27 and one mix Other vat dyes are possible.

The vat dyed modacrylic/cellulosic blend fabric is then pre-dried in a pre-drying zone to a desired moisture level. The moisture level is the moisture weight as a percentage of the fabric weight. Many different pre-drying operations and equipment can be used. The pre-drying zone can be comprised of a single stage drying process or multiple stages. The pre-drying process can include infrared drying, passing the fabric over heated surfaces such as drying cans, or contacting the fabric with hot gases such as air. An infra-red predryer can for example reduce moisture level to 28-30%. Steam heated dry cans can be used to further reduce the moisture level to 15-18%. Hot air flue gas temperatures of for example 200° F. can be used to reduce the final moisture level measured to 3-5%.

The vat dyed modacrylic/cellulosic blend fabric is then contacted with a reducing agent. The reducing agent reduces the vat dye to its lueco form, in which the vat dye is very water soluble. Many different processes and equipment can be used to apply the reducing agent to the fabric. In one embodiment, the fabric is immersed in the reducing agent solution followed by optionally passing the saturated fabric through squeeze rolls or nip rolls typically employed in a dye pad. Other application processes such as spraying, wiping or immersing are also possible.

Different reducing agents are possible. A reducing composition comprising sodium hydroxide and sodium hydrosulfite can be used. Other reducing agents are possible. A wetting agent can be applied with the reducing agent. The wetting agent is an alkaline-stable surfactant or surface-active agent that helps to disperse the vat dye in the water.

The vat dyes are not water soluble until they are reduced, typically with sodium hydroxide and sodium hydrosulfite (hydro) that render the dyes soluble. They then penetrate the fiber, especially the cellulosic fiber. The dyes are trapped inside—it is not a chemical reaction but instead a mechanical entrapment.

The vat dyed modacrylic/cellulosic blend fabric is then steamed to promote dye penetration into the fibers. The steam imparts energy into the fabric and helps to drive the dye deep within the fabric. Different steam delivering processes and equipment are possible. The steaming process may facilitate the uptake of the dyes by the modacrylic portion of the fabric.

The vat dyed modacrylic/cellulosic fabric is then washed in a first wash zone with a wash composition comprising water to remove excess vat dye and reducing agent. The first wash zone can be comprised of a single wash step and station or multiple wash steps and stations. The washed fabric can then be passed through a squeeze or nip rolls or another pressing device to squeeze out excess liquid. The first wash zone can comprise serial wash steps, each wash step having a graduated temperature that is greater than the preceding wash step. In one non-limiting example, the temperatures of the wash steps can vary, with a graduated rise in temperature from approximately 100° F. to approximately 140° F.

An oxidizing zone is provided to neutralize the dyes such that they will be insoluble again and permanently trapped inside the fibers. The vat dyed modacrylic/cellulosic blend fabric is contacted with an oxidizing agent. Different processes and apparatus for applying the oxidizing agent to the fabric are possible. The oxidizing agent can comprise hydrogen peroxide. The oxidizing agent can be 50% hydrogen peroxide titrated to a 5% solution. Other oxidizing agents are possible. The oxidizing step can include the step of contacting the vat dyed modacrylic fabric with an alkaline stable surfactant solution have a pH of from 7.2 to 7.8.

The vat dyed modacrylic/cellulosic blend fabric can be washed in a second wash zone to remove excess oxidizing agent. Many different wash processes and equipment can be used. The second wash zone can comprise a single wash step and station, or multiple wash steps and stations.

After the second washing zone the fabric is dried in a post-dyeing drying process. Many different drying processes and equipment are possible. In one embodiment, the fabric is passed over heated drying cans.

The fabric can be treated after dyeing with post-fabrication treatments. One such treatment is the application of a flame retardant compound to the fabric. Different flame retardant compounds are possible. The flame retardant compound can be at least one selected from the group consisting of THPC: tetrakis hydroxymethyl phosphonium chloride, THPS tetrakis hydroxymethyl phosphonium sulfate, and Pyrovatex®. The flame retardant material must be durable to extended launderings to be considered useful. Pyrovatex is used in some countries.

Arc testing establishes the arc rating (a measure of thermal protection from electric arc flash). An industry-accepted standard for many electrical safety requirements is National Fire Protection Association (NFPA) 70E. Among other things, this standard provides guidance for levels of protection from electric arc flash exposure. The standard includes tables that describe work tasks and recommends protection categories of 0 through 4 for these tasks. It has been estimated that category 2 rated garments would offer sufficient protection for at least 75% of all electrical work performed in the U.S. The minimum arc rating needed to achieve category 2 electric arc protection is 8 calories/$cm^2$ as determined by ASTM Standard Test Method F1959. The preferred embodiment of this invention when tested by this standard achieved an arc rating of 8.8 calories/$cm^2$, above the 8.0 threshold needed for a category 2 fabric.

The method can include the step of treating the dyed modacrylic fabric with a moisture control agent. Moisture control agents and treatments are known and any suitable such control agent or process can be used. The moisture control agent in one embodiment is the Sta-Cool® process from David C. Pool Co. (Greenville S.C.). Other moisture control treatment processes include FYnesse® by Fiber & Yarn Products, Inc. (Hickory, N.C.), and Sorbtek® from Unifi (Greensboro N.C.).

FIG. 1 is a flow diagram of a process 10 according to the invention. A modacrylic/cellulosic blend fabric 14 is provided from a source and receives vat dye from dye pad 22 and is passed through nip rolls 18. A vat dye-containing modacrylic/cellulosic blend fabric 26 exits the pad 18. The fabric 26 is then passed to a pre-dry zone, where a series of drying steps can follow. Any suitable pre-drying process is possible. As shown in this embodiment, the fabric 26 first enters an infrared pre-dryer 30. The fabric 26 then can be passed over pre-dry cans 34 which can be cylinders heated by a suitable source such as steam or resistance heating. The fabric 26 next enters hot air flue pre-dryer 38 where the fabric 26 is heated by a hot dry gas. A dried vat dye-containing modacrylic/cellulosic blend fabric 42 exits the pre-drying zone.

The dried vat dyed modacrylic/cellulosic fabric 42 then enters a reduction zone. In the reduction zone, the fabric 42 is contacted with the reducing agent. The fabric 42 can be passed to pad 52 where the fabric will be contacted with the reducing agent from pad 52 and then passed through nip rolls 50 to remove excess reducing agent. With the vat dye now in the reduced lueco form and water-soluble, the vat dye penetrates and is secured within the fabric 42 to produce a vat dyed modacrylic/cellulosic blend fabric 46. The fabric 46 passes to the steamer 54 where the steam facilitates the dye fully penetrating the fabric 46.

The fabric 46 then enters a wash zone 60. In the wash zone 60 the fabric 46 can be contacted with water to remove residual vat dye and reducing agent. A series of wash stations 62, 64 and 66 can be provided in the wash zone 60 having graduated and increasing temperatures.

The dyed and washed fabric 46 then enters an oxidation zone 70. In the oxidation zone 70, the fabric 46 is contacted with an oxidizing agent at a station 72 to neutralize the vat dye and secure it within the fabric 46. The oxidation zone 70 can further include a soaping station 74 where the fabric 46 is contacted with an alkaline stable surfactant to remove excess dye and wash the fabric 46.

The fabric 46 next enters a final wash zone 80. In the final wash zone 80 the fabric 46 is contacted with water to remove any residuary materials such as vat dye, soap and oxidizing agent. A series of wash stations 82, 84, 86, and 88 can be provided.

The fabric 46 then enters a final dry zone. A dry station 90 in the final dry zone 90 can be comprised of dry cans to remove residual moisture from the final wash zone 80. The finished vat dyed modacrylic/cellulosic fabric 100 then exits the process.

EXAMPLE

A modacrylic/cellulosic blend fabric was prepared having a blend of 72/28 cotton/modacrylic. Vat dye compositions were provided as listed in Table 1:

TABLE 1

Vat Dye Formulas for Five Shades Dyed on Modacrylic Cotton Fabric

| Dye Shade | Vat Dyes | Grams/liter |
|---|---|---|
| Khaki | Brown #1 | 4.836 |
| | Black #25 | 2.851 |
| | Yellow #33 | 3.51 |
| Olive | Green #3 | 10.68 |
| | Black #25 | 37.27 |
| | Yellow #33 | 1.98 |
| Royal | Blue #6 | 22.20 |
| | Violet #13 | 13.89 |
| | Black #25 | 0.71 |
| Medium Blue | Blue #6 | 6.03 |
| | Violet #13 | 1.40 |
| | Orange #2 | 1.15 |
| Navy | Black #16 | 56.70 |
| | Orange #2 | 9.78 |
| | Violet #13 | 2.75 |

The following process compositions were used.

| Reduction Mix (Chemical Pad) | |
|---|---|
| Sodium Hydroxide 50% | 120 g/l |
| Sodium Hydrosulfite powder | 60 g/l |
| Penetrant | 2 g/l |

Oxidizing Agent

Hydrogen Peroxide 50% Titrated to 5% solution

Soaping (Oxidation Zone)

Alkaline stable surfactant pH adjusted with buffer to 7.2 to 7.8

The following machine set up parameters were used:

Equipment Settings

Dye pad fabric pickup: 70%.

Infra-red predryer reducing moisture level to 28-30%.

Steam heated dry cans were used to further reduce the moisture to 15-18%.

Hot air flue gas temperatures of 200° F. were used to reduce the final moisture level measured to 3-5%.

Cooling section before chemical (reducing agent) pad—the chemical pad was kept cool with the set removed (no squeeze). A cool (no heat) chemical pad allows the reduction chemicals to remain effective longer. Set removed (no squeeze) refers to a configuration where the squeeze rolls were open, so no moisture was squeezed out of the fabric—allowing for maximum wet pickup. This is desirable where an excess of reducing agent is desired to insure better reduction of the vat dyes.

The steamer was set to 218° F. with a full minute of steaming time with the water seal temperature measured 80-90° F.

The wash boxes included fresh water with a graduated rise in temperature from 100° F. to 140° F.

The oxidation was allowed to continue for 45-60 seconds.

Evaluation of color durability to laundering and light exposure of apparel fabrics were conducted via controlled laboratory tests. Satisfactory results from these tests of color durability (colorfastness) to laundering and light exposure are important thresholds to cross for a dyed fabric to become commercially viable. When fibers are dyed by methods that are not designed for those fibers as in this invention, the resulting fabric may have deficiencies in colorfastness. Embodiments of the invention were evaluated for these properties by 2 industry standard test methods; AATCC TM 16.3 Colorfastness to Light: Xenon-Arc and AATCC TM 61-2A Colorfastness to Laundering: Accelerated. Test method 16.3 evaluates colorfastness to light by exposing specimens of fabric to light from a high-intensity xenon light that is filtered to closely simulate the spectral energy distribution of sunlight. The intensity of this light source allows a few hours of xenon light exposure to simulate the effect of much longer periods of exposure to sunlight. For apparel fabrics, a 20 hour exposure is typically considered the standard with 40 hour exposure as an option for premium products or materials expected to experience prolonged sunlight exposure.

Test method 61-2A evaluates colorfastness to laundering by placing small specimens of dyed fabric in a stainless steel container along with a piece of multi-fiber fabric (containing bands of acetate, cotton, nylon, silk, rayon, and wool), standard detergent and 50 stainless steel balls. The container is sealed and placed in a mechanism that rotates in a water bath maintained at 120° F. for 45 minutes. At the end of the 45 minute cycle, the specimens are removed from the stainless container, rinsed clean and dried. This process is said to simulate the color loss expected from 5 wash cycles in a home washing machine.

The results of both test methods were evaluated using the AATCC Gray Scale for Color Change. This evaluation employs 10 pairs of gray tiles comparing a dark tile to a progressively lighter tile. The difference between tiles allows for rating color change by comparing the original color depth to the color after washing or light exposure and finding the pair of tiles that most closely matches the change. The rating system is from 1 to 5, with 5 being no color change and 1 being significant color change. Test method 61-2A also allows evaluation of color transference or staining onto the 6 fibers contained in the multi-fiber fabric using one of two scales known as the Gray Scale for Staining or AATCC Scale for Chromatic Transference. In the dye embodiments described in Table 1 the dye did not transfer onto any of the fibers in the multi-fiber, so no rating was assigned to staining. This is not unusual for vat dyeing since the unreduced vat dye has very little affinity for these fibers. The results of the colorfastness to light, and colorfastness to laundering tests are shown in Table 2:

TABLE 2

Colorfastness to Light and Laundering of Five Shades Dyed on Modacrylic Cotton Fabric

| Dye Shade | Colorfastness to Light Rating* | | Colorfastness to Laundering |
|---|---|---|---|
| | 20 hour | 40 hour | Rating** |
| Khaki | 4-5 | 4 | 4-5 |
| Olive | 4-5 | 4-5 | 4 |
| Royal | 4-5 | 4-5 | 4 |
| Medium Blue | 4 | 4 | 4-5 |
| Navy | 4-5 | 4-5 | 3-4 |

*Colorfastness to Light as determined by AATCC TM 16.3
**Colorfastness to Laundering: Accelerated AATCC TM 61 - 2A
Colorfastness tests were rated by AATCC Gray Scale for Color Change The ratings for both wash fastness and light fastness are good and would be considered well within the range of acceptable performance for commercial apparel fabrics.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alterations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A method for dyeing a modacrylic/cellulosic blend fabric, comprising the steps of:

providing a modacrylic/cellulosic blend fabric comprising modacrylic fibers and cellulosic fibers;

applying an aqueous vat dye composition comprising water and a vat dye to the modacrylic/cellulosic blend fabric to provide a vat dyed modacrylic/cellulosic blend fabric;

drying the vat dyed modacrylic/cellulosic blend fabric;

contacting the vat dyed modacrylic/cellulosic blend fabric with a reducing agent;

steaming the vat dyed modacrylic/cellulosic blend fabric to promote dye penetration into the fibers washing the vat dyed modacrylic/cellulosic blend fabric in a first wash step with a wash composition comprising water to remove excess vat dye and reducing agent;

contacting the vat dyed modacrylic/cellulosic blend fabric with an oxidizing agent; and washing the vat dyed modacrylic/cellulosic blend fabric in a second wash step to remove excess oxidizing agent.

2. The method of claim 1, wherein the oxidizing agent comprises hydrogen peroxide.

3. The method of claim 1, wherein the reducing agent comprises at least one selected from the group consisting of sodium hydroxide and sodium hydrosulfite.

4. The method of claim 3, wherein the step of contacting the vat dyed modacrylic/cellulosic blend fabric with a reducing agent includes providing a wetting agent.

5. The method of claim 1, wherein the drying step comprises infrared drying.

6. The method of claim 1, wherein the drying step comprises hot flue drying.

7. The method of claim 1, wherein the drying step comprises the step of passing the vat dyed modacrylic/cellulosic blend fabric over steam cans.

8. The method of claim 1, wherein after the second wash step, the vat dyed modacrylic/cellulosic blend fabric is passed over steam cans.

9. The method of claim 1, wherein the first wash step comprises serial wash steps, each wash step having a graduated temperature that is greater than the preceding wash step.

10. The method of claim 1, wherein the oxidation agent is 50% hydrogen peroxide titrated to a 5% solution.

11. The method of claim 1, wherein after the oxidation step the vat dyed modacrylic/cellulosic blend fabric is contacted with an alkaline stable surfactant solution buffered to a pH of from 7.2 to 7.8.

12. The method of claim 1, wherein the vat dye comprises at least one selected from the group consisting of Vat Red 10, 13, 15 and 31, Vat Orange 1, 2 and 7, Vat Yellow 2 and 33, Vat Green 1 and 3, Vat Blue 6, 66, Vat Violet 1 and 13, Vat Brown 1, 3, and 57, Vat Grey 2, Vat Black 16, 25, and 27, and combinations thereof.

13. The method of claim 1, wherein the modacrylic fibers comprise at least one selected from the group consisting of Protex-Q, Protex C, and Protex M.

14. The method of claim 1, wherein the cellulosic fibers comprise at least one selected from the group consisting of cotton, rayon, lyocell (Tencel), flax, ramie, hemp, and jute.

15. The method of claim 1, wherein the modacrylic fiber has a denier per filament (dpf) of from 1.2 to 2.

16. The method of claim 1, wherein the modacrylic fibers comprise from 80-20 wt % and the cellulosic fibers comprise 20-80 wt. % of the modacrylic/cellulosic blend fabric.

17. The method of claim 1, further comprising the step of treating the dyed modacrylic/cellulosic blend fabric with a flame retardant compound comprising at least one selected from the group consisting of THPC: tetrakis hydroxymethyl phosphonium chloride, THPS tetrakis hydroxymethyl phosphonium sulfate, and Pyrovatex.

18. The method of claim 1, further comprising the step of pre-treating yarn used to make the modacrylic/cellulosic fabric with a moisture control agent.

19. The method of claim 18, wherein the moisture control agent comprises at least one selected from the group consisting of StaCool and Sorbtek.

* * * * *